US005867945A

United States Patent [19]

Scafidi

[11] Patent Number: 5,867,945

[45] Date of Patent: Feb. 9, 1999

[54] SELF-CLEANING GUTTER

[76] Inventor: Stephen J. Scafidi, 68 Hawthorne Rd., Kings Park, N.Y. 11754

[21] Appl. No.: 90,175

[22] Filed: Jun. 4, 1998

[51] Int. Cl.[6] ..... E04D 13/08

[52] U.S. Cl. ..... 52/16; 52/11; 52/12; 52/15

[58] Field of Search ..... 52/11, 12, 15, 52/16, 58

[56] References Cited

U.S. PATENT DOCUMENTS

| | | | |
|---|---|---|---|
| 4,309,792 | 1/1982 | Faye | 16/389 |
| 4,311,292 | 1/1982 | Deason | 248/48 |
| 4,432,518 | 2/1984 | Navarre | 248/48 |
| 4,696,131 | 9/1987 | Schreffler | 52/11 |
| 4,709,516 | 12/1987 | Gleaves | 52/11 |
| 4,745,657 | 5/1988 | Faye | 16/226 |
| 4,837,987 | 6/1989 | Fender | 52/11 |
| 5,170,596 | 12/1992 | Zadok et al. | 52/16 |
| 5,335,460 | 8/1994 | Smith, Jr. | 52/11 |
| 5,357,719 | 10/1994 | Lewis | 52/11 |
| 5,802,774 | 9/1998 | Kardacz | 52/11 |

*Primary Examiner*—Robert Canfield
*Assistant Examiner*—Yvonne Horton-Richardson

[57] ABSTRACT

A rain gutter system is provided including a frame having an elongated bottom face and a side wall coupled to the bottom face and extending upwardly therefrom. The side wall of the frame is defined by a front face, a rear face and a pair of side faces thus forming an interior space and an upper peripheral edge. An upper edge of the rear face is coupled to an upper surface of a roof. The bottom face has a cut out formed therein for residing in communication with a downwardly extending drain pipe. Also included is an inner basin with a shape and size similar to that of the frame. An upper edge of the front face of the inner basin is pivotally coupled to an upper edge of the front face of the frame for pivoting between a first orientation and a second orientation wherein the water basin is inverted in front of the frame.

8 Claims, 3 Drawing Sheets

SELF-CLEANING GUTTER

BACKGROUND OF THE INVENTION

1. Field of the Invention

The present invention relates to gutter systems and more particularly pertains to a new self-cleaning gutter for emptying debris from a rain gutter.

2. Description of the Prior Art

The use of gutter systems is known in the prior art. More specifically, gutter systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art gutter systems include U.S. Pat. No. 4,043,527; U.S. Pat. No. 4,807,406; U.S. Pat. No. 4,634,312; U.S. Pat. No. 4,305,236; U.S. Pat. No. 4,411,110; and U.S. Pat. No. 353,189.

In these respects, the self-cleaning gutter according to the present invention substantially departs from the conventional concepts and designs of the prior art, and in so doing provides an apparatus primarily developed for the purpose of emptying debris from a rain gutter.

SUMMARY OF THE INVENTION

In view of the foregoing disadvantages inherent in the known types of gutter systems now present in the prior art, the present invention provides a new self-cleaning gutter construction wherein the same can be utilized for emptying debris from a rain gutter.

The general purpose of the present invention, which will be described subsequently in greater detail, is to provide a new self-cleaning gutter apparatus and method which has many of the advantages of the gutter systems mentioned heretofore and many novel features that result in a new self-cleaning gutter which is not anticipated, rendered obvious, suggested, or even implied by any of the prior art gutter systems, either alone or in any combination thereof.

To attain this, the present invention generally comprises a frame having an elongated bottom face and a side wall coupled to the bottom face and extending upwardly therefrom. As shown in the Figures, the side wall is defined by a front face, a rear face and a pair of side faces thus forming an interior space and an upper peripheral edge. An upper edge of the rear face of the frame has a planar rectangular mounting flange integrally coupled thereto and extending upwardly and rearwardly therefrom. The mounting flange serves for coupling with an upper surface of a roof. As shown in FIG. 2, the bottom face of the frame has a plurality of columns of upwardly extending rests coupled thereto. It should be noted that a height of the rests of each column decreases from a first side face to a second side face. Further, a rectangular cut out is formed in the bottom face of the frame adjacent to the second side face thereof. Such cut out resides in communication with a downwardly extending drain pipe. With reference still to FIG. 2, a first gear assembly is provided including an elongated post rotatably coupled to an interior surface of the rear face of the frame adjacent to the upper peripheral edge thereof. The post extends along an entire length of the frame and further through the second side face of the frame. Also, the post has a plurality of pinions coupled thereto in coaxial relationship therewith. An end gear is situated on an end of the post exterior of the second side face, as shown in FIG. 4. Also included is an inner basin having an elongated bottom face and a side wall coupled to the bottom face and extending upwardly therefrom. The side wall of the inner basin is defined by a front face, a rear face and a pair of side faces thus forming an interior space and an upper peripheral edge. As shown in FIG. 3, the bottom face of the inner basin resides in an angled plane extending downwardly from a first side face of the inner basin to a second side face thereof. A rectangular cut out is formed in the inner basin adjacent to the second side face of the inner basin. Coupled about a periphery of the cut out of the inner basin is a water cuff which extends downwardly therefrom with a generally frustoconical configuration. As shown in FIG. 3, the front face of the water basin is equipped with a plurality of thin elongated stoppers coupled thereto and extending upwardly beyond the upper peripheral edge of the inner basin in a generally vertical orientation. An upper edge of the front face of the inner basin is pivotally coupled to an upper edge of the front face of the frame for pivoting between a first orientation and a second orientation. In the first orientation, the inner basin remains within the frame with the water cuff extending through the cut out of the frame. In the second orientation, the water basin is inverted and held in place by the stoppers which abut a front face of the frame. For reasons that will soon become apparent, an upper edge of the rear face of the inner basin has a plurality of arcuate racks coupled thereto and extending downwardly therefrom. In use, the arcuate racks are adapted for engaging the pinions of the first gear assembly. Next provided is a second gear assembly including an end gear mounted along an axis associated with the pivotal coupling between inner basin and the frame. The end gear of the second gear assembly is fixed with respect to the inner basin and resides exterior of the second side face of the frame. A motor is mounted to the roof and connected to the end gears of the first and second gear assembly. By this structure, the motor is adapted for selectively effecting the tipping of the basin into the second orientation thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new self-cleaning gutter apparatus and method which has many of the advantages of the gutter systems mentioned heretofore and many novel features that result in a new self-cleaning gutter which is not anticipated, rendered obvious, suggested, or even implied by any of the prior art gutter systems, either alone or in any combination thereof.

It is another object of the present invention to provide a new self-cleaning gutter which may be easily and efficiently manufactured and marketed.

It is a further object of the present invention to provide a new self-cleaning gutter which is of a durable and reliable construction.

An even further object of the present invention is to provide a new self-cleaning gutter which is susceptible of a low cost of manufacture with regard to both materials and labor, and which accordingly is then susceptible of low prices of sale to the consuming public, thereby making such self-cleaning gutter economically available to the buying public.

Still yet another object of the present invention is to provide a new self-cleaning gutter which provides in the apparatuses and methods of the prior art some of the advantages thereof, while simultaneously overcoming some of the disadvantages normally associated therewith.

Still another object of the present invention is to provide a new self-cleaning gutter for emptying debris from a rain gutter.

Even still another object of the present invention is to provide a new self-cleaning gutter that includes a frame having an elongated bottom face and a side wall coupled to the bottom face and extending upwardly therefrom. The side wall of the frame is defined by a front face, a rear face and a pair of side faces thus forming an interior space and an upper peripheral edge. An upper edge of the rear face is coupled to an upper surface of a roof. The bottom face has a cut out formed therein for residing in communication with a downwardly extending drain pipe. Also included is an inner basin with a shape and size similar to that of the frame. An upper edge of the front face of the inner basin is pivotally coupled to an upper edge of the front face of the frame for pivoting between a first orientation and a second orientation wherein the water basin is inverted in front of the frame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
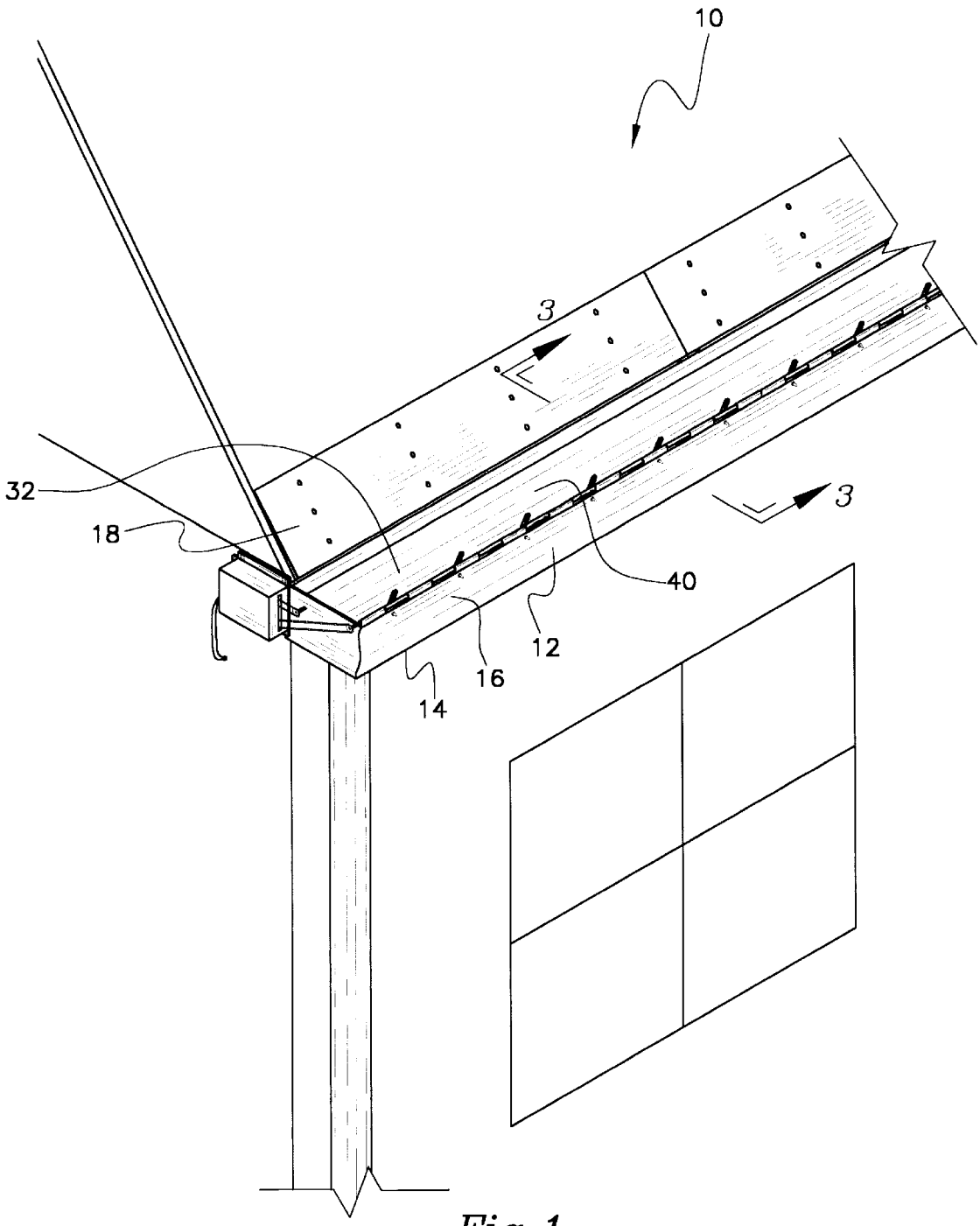
FIG. 1 is a perspective view of a new self-cleaning gutter according to the present invention.

With reference now to the drawings, and in particular to FIGS. 1 through 5 thereof, a new self-cleaning gutter embodying the principles and concepts of the present invention and generally designated by the reference numeral 10 will be described.

The present invention, designated as numeral 10, includes a frame 12 having an elongated bottom face 14 and a side wall 16 coupled to the bottom face and extending upwardly therefrom. As shown in the Figures, the side wall is defined by a front face, a rear face and a pair of side faces thus forming an interior space and an upper peripheral edge. An upper edge of the rear face of the frame has a planar rectangular mounting flange 18 integrally coupled thereto and extending upwardly and rearwardly therefrom. The mounting flange serves for coupling with an upper surface of a roof.

Figure 2:
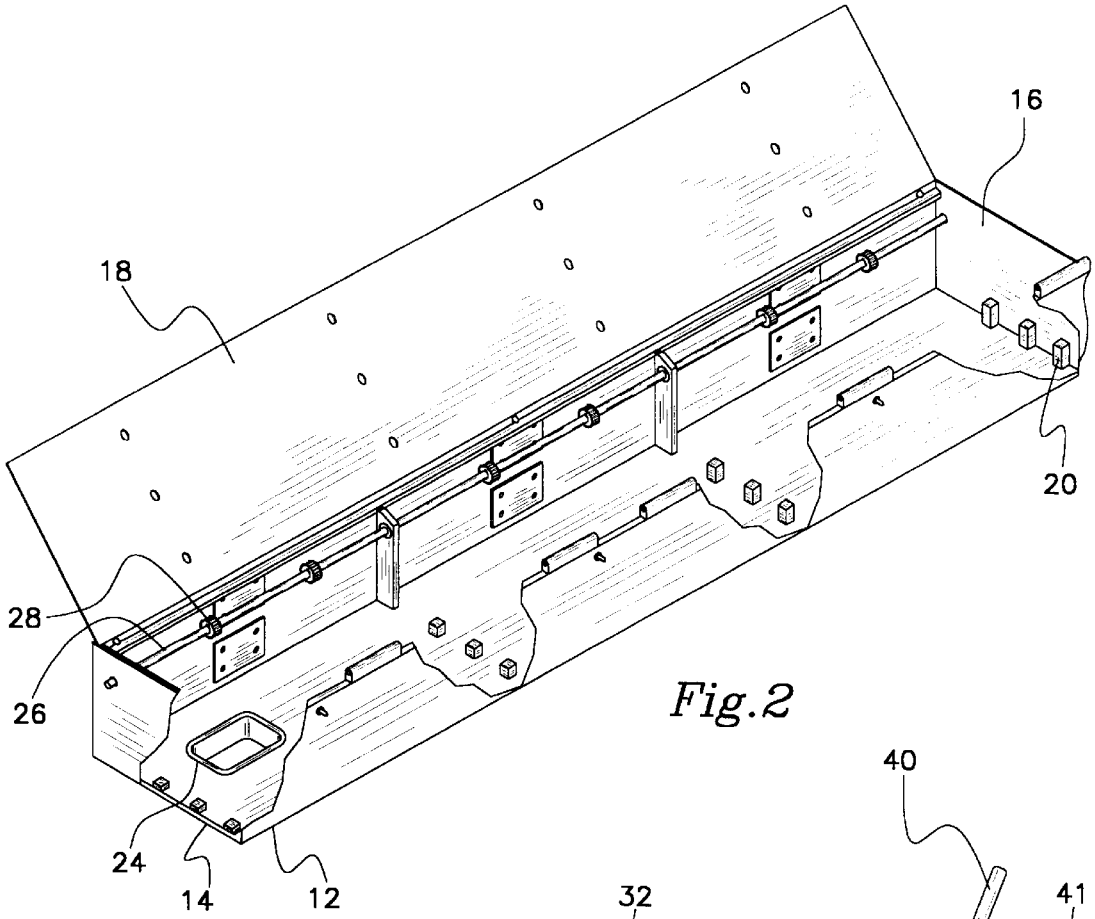
FIG. 2 is a perspective view of the frame of the present invention with the front and side face drawn in phantom.

As shown in FIG. 2, the bottom face of the frame has a plurality of columns of upwardly extending rests 20 coupled thereto. It should be noted that a height of the rests of each column decreases from a first side face to a second side face. Further, a rectangular cut out 24 is formed in the bottom face of the frame adjacent to the second side face thereof. Such cut out resides in communication with a downwardly extending drain pipe.

Figure 4:
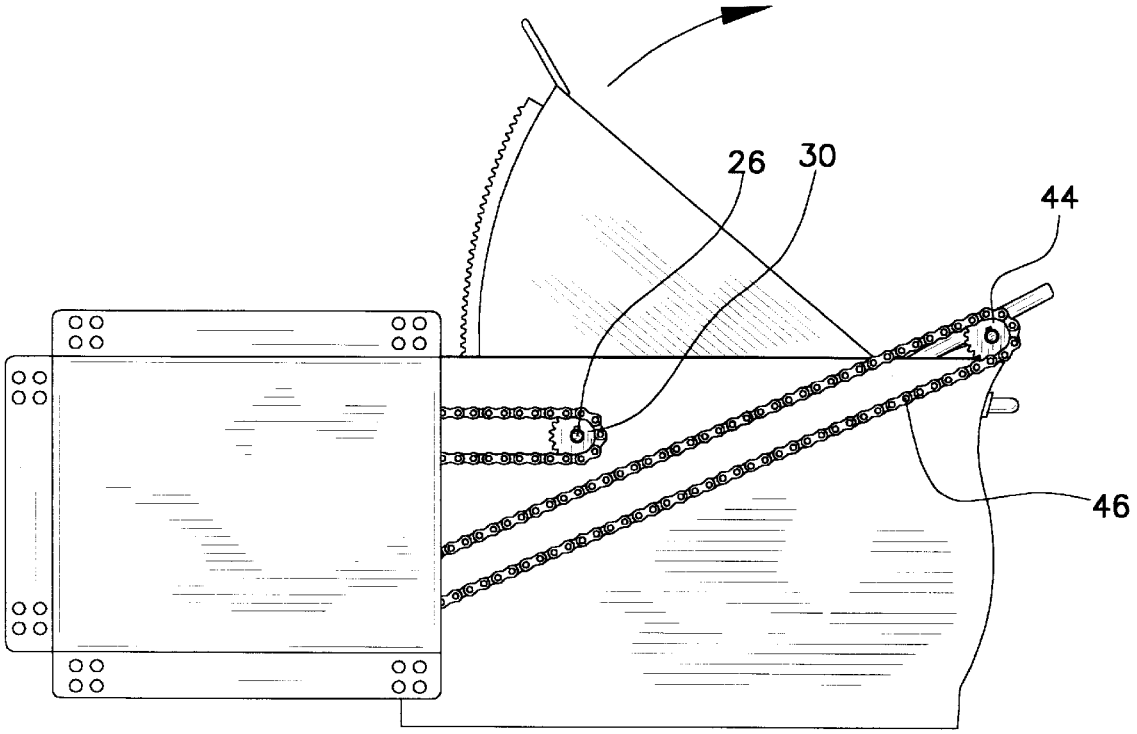
FIG. 4 is a side view of the present invention.
Figure 5:
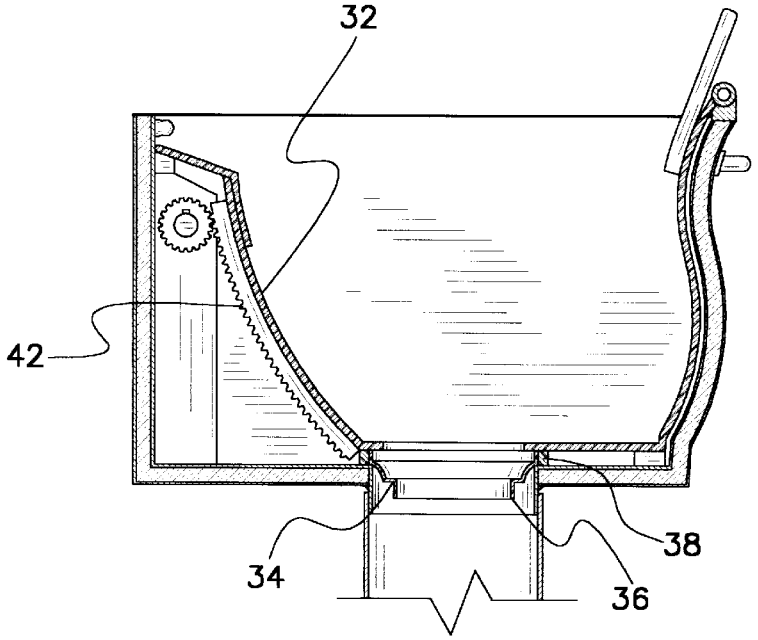
FIG. 5 is a side cross-sectional view of the present invention depicting the water cuff.

With reference still to FIG. 2, a first gear assembly is provided including an elongated post 26 rotatably coupled to an interior surface of the rear face of the frame adjacent to the upper peripheral edge thereof. This is accomplished by way of a plurality of vertical mounting lips extending inwardly from the rear face of the frame. The post extends along an entire length of the frame and further through the second side face of the frame. Also, the post has a plurality of pinions 28 coupled thereto in coaxial relationship therewith. An end gear 30 is situated on an end of the post exterior of the second side face, as shown in FIG. 4.

Also included is an inner basin 32 having an elongated bottom face and a side wall coupled to the bottom face and extending upwardly therefrom. The side wall of the inner basin is defined by a front face, a rear face and a pair of side faces thus forming an interior space and an upper peripheral edge. In the preferred embodiment, an upper edge of the rear face of the inner basin is extended rearwardly, as shown in FIG. 3, for reasons that will become apparent.

Figure 3:
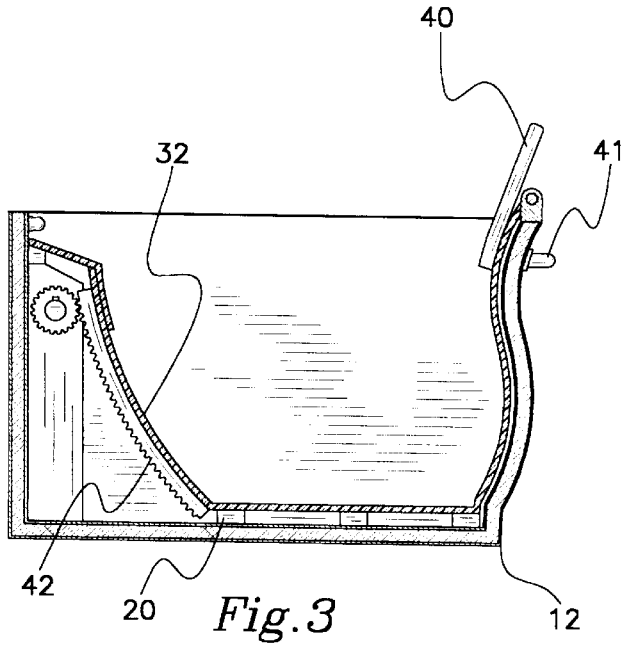
FIG. 3 is a side cross-sectional view of the present invention taken along line 3—3 shown in FIG. 1.

As shown in FIG. 3, the bottom face of the inner basin resides in an angled plane extending downwardly from a first side face of the inner basin to a second side face thereof. A rectangular cut out 34 is formed in the inner basin adjacent to the second side face of the inner basin. Coupled about a periphery of the cut out of the inner basin is a water cuff 36 which extends downwardly therefrom with a generally frusto-conical configuration. Associated with the water cuff is a drain ring 38 which provides a seal between the inner basin and the cut out of the frame.

As shown in FIG. 3, the front face of the water basin is equipped with a plurality of thin elongated stoppers 40 coupled thereto and extending upwardly beyond the upper peripheral edge of the inner basin in a generally vertical orientation. An upper edge of the front face of the inner basin is pivotally coupled to an upper edge of the front face of the frame for pivoting between a first orientation and a second orientation. In the first orientation, the inner basin remains within the frame with the water cuff extending through the cut out of the frame. In the second orientation, the water basin is inverted and held in place by the stoppers which abut a front face of the frame. It should be noted that the stoppers preferably abut associated bumpers 41 on the front face of the frame to prevent the inner basin from rotating past a 180 degrees from the first orientation.

When the inner basin is in the first orientation, a space is formed between the bottom faces of the inner basin and the frame. As an option, a heater coil or the like may be situated within the such space for removing any ice prior to use. Insulation may also be situated within the space for similar purposes.

For reasons that will soon become apparent, an upper edge of the rear face of the inner basin has a plurality of arcuate racks 42 coupled thereto and extending downwardly therefrom. The racks each have a radius of curvature centered at the upper edge of the front face of the inner basin. In use, the arcuate racks are adapted for engaging the pinions of the first gear assembly.

Next provided is a second gear assembly including an end gear 44 mounted along an axis associated with the pivotal coupling between inner basin and the frame. The end gear of the second gear assembly is fixed with respect to the inner basin and resides exterior of the second side face of the frame. A motor is mounted to the roof and connected to the end gears of the first and second gear assembly via a pair of chains 46. Preferably, a cover is employed to contain the chains and motor. By this structure, the motor is adapted for selectively effecting the tipping of the basin into the second orientation thereof. It should be understood that the rack and pinions of the first gear assembly aid in the first 90 degrees of rotation of the inner basin. Any amount of debris may thus be conveniently disposed of during use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rain gutter system comprising, in combination:

a frame including an elongated bottom face and a side wall coupled to the bottom face and extending upwardly therefrom, the side wall defined by a front face, a rear face and a pair of side faces thus forming an interior space and an upper peripheral edge, an upper edge of the rear face having a planar rectangular mounting flange integrally coupled thereto and extending upwardly and rearwardly therefrom for coupling with an upper surface of a roof, the bottom face having a plurality of columns of upwardly extending rests coupled thereto wherein a height of the rests of each column decreases from a first side face to a second side face and a rectangular cut out formed in the bottom face of the frame adjacent to the second side face thereof for residing in communication with a downwardly extending drain pipe;

a first gear assembly including an elongated post rotatably coupled to an interior surface of the rear face of the frame adjacent to the upper peripheral edge thereof, the post extending along an entire length of the frame and further through the second side face of the frame, the post having a plurality of pinions coupled thereto in coaxial relationship therewith and an end gear situated on an end of the post exterior of the second side face;

an inner basin including an elongated bottom face and a side wall coupled to the bottom face and extending upwardly therefrom, the side wall defined by a front face, a rear face and a pair of side faces thus forming an interior space and an upper peripheral edge, the bottom face residing in an angled plane extending downwardly from a first side face of the inner basin to a second side face thereof and further having a rectangular cut out formed therein adjacent to the second side face of the inner basin with a water cuff extending downwardly therefrom with a generally frusto-conical configuration, the front face having a plurality of thin elongated stoppers coupled thereto and extending upwardly beyond the upper peripheral edge of the inner basin in a generally vertical orientation, an upper edge of the front face of the inner basin being pivotally coupled to an upper edge of the front face of the frame for pivoting between a first orientation within the frame with the water cuff extending through the cut out of the frame and a second orientation wherein the water basin is inverted and held in place by the stoppers which abut a front face of the frame, an upper edge of the rear face of the inner basin having a plurality of arcuate racks coupled thereto and extending downwardly therefrom for engaging the pinions of the first gear assembly; and a second gear assembly including an end gear mounted along an axis associated with the pivotal coupling between inner basin and the frame, the gear fixed with respect to the inner basin and residing exterior of the second side face of the frame, wherein a motor is mounted to the roof and connected to the end gears of the first and second gear assembly for selectively effecting the tipping of the basin into the second orientation thereof.

2. A rain gutter system comprising:

a frame including an elongated bottom face and a side wall coupled to the bottom face and extending upwardly therefrom, the side wall defined by a front face, a rear face and a pair of side faces thus forming an interior space and an upper peripheral edge, the rear face coupled to a roof, the bottom face having a cut out formed therein for residing in communication with a downwardly extending drain pipe; and an inner basin including an elongated bottom face and a side wall coupled to the bottom face and extending upwardly therefrom, the side wall defined by a front face, a rear face and a pair of side faces, an upper edge of the front face of the inner basin being pivotally coupled to an upper edge of the front face of the frame for pivoting between a first orientation and a second orientation wherein the water basin is inverted in front of the frame.

3. A rain gutter system as set forth in claim 2 wherein the front face of the inner basin has a plurality of stoppers extending beyond the upper peripheral edge thereof for engaging the front face of the frame when in the second orientation.

4. A rain gutter system as set forth in claim 2 wherein the bottom face of the inner basin is angled downwardly between a first side face and a second side face thereof.

5. A rain gutter system as set forth in claim 4 wherein the bottom face of the frame has a plurality of rests mounted thereon with a decreasing height from a first side face to a second side face of the frame.

6. A rain gutter system as set forth in claim 2 wherein a first gear is mounted on an upper edge of the front face of the inner basin adjacent to one of the side faces thereof for being connected to a motor thus pivoting the inner basin between the first and second orientation.

7. A rain gutter system as set forth in claim 6 and further including at least one pinion mounted to the rear face of the frame and in communication with the motor, the inner basin having at least one arcuate rack coupled thereto and engaged with the pinion for facilitating the pivoting of the inner basin between the first and second orientation.

8. A rain gutter system as set forth in claim 2 wherein the inner basin has a cut out formed in the bottom face thereof with a cuff coupled thereto and extending downwardly therefrom for being situated within the cut out of the frame when the inner basin is in the first orientation thereof.

* * * * *